US006176210B1

(12) United States Patent
Lichti et al.

(10) Patent No.: US 6,176,210 B1
(45) Date of Patent: Jan. 23, 2001

(54) AXIALLY-COMPACT CAM PHASER HAVING AN INVERTED BEARING

(75) Inventors: Thomas Howard Lichti, Fairport; Michael James Fox, Stafford, both of NY (US)

(73) Assignee: Delphi Technologies, Inc., Troy, MI (US)

( * ) Notice: Under 35 U.S.C. 154(b), the term of this patent shall be extended for 0 days.

(21) Appl. No.: 09/395,124

(22) Filed: Sep. 14, 1999

(51) Int. Cl.[7] ..... F01L 1/34
(52) U.S. Cl. ..... 123/90.17; 74/568 R; 464/160
(58) Field of Search ..... 123/90.17, 90.31, 123/90.15; 74/567, 568 R; 464/1, 2, 160

(56) References Cited

U.S. PATENT DOCUMENTS 5,163,872 * 11/1992 Niemiec ..... 464/2
5,588,404 * 12/1996 Lichti ..... 123/90.17
5,592,909 * 1/1997 Tsuruta ..... 123/90.17
5,813,378 * 9/1998 Sato ..... 123/90.17

* cited by examiner

*Primary Examiner*—Thomas Denion
*Assistant Examiner*—Patrick Cavaliere
(74) *Attorney, Agent, or Firm*—John A. VanOphem

(57) ABSTRACT

An axially-compact camshaft phaser wherein the phaser bearing flange on the camshaft, connected to a timing chain sprocket or cam drive gear, is axially inverted in comparison to prior art cam phasers so that the bearing flange extends axially and inwardly of the phaser stator and rotor such that radial drive load on the phaser is sustained within the hydraulic portion of the phaser rather than externally thereof. The overall axial length of the phaser may be reduced thereby by about 25% relative to some prior art phasers and the Phaser Envelop volume may be reduced by 15% while maintaining an equivalent torque capacity.

10 Claims, 2 Drawing Sheets

AXIALLY-COMPACT CAM PHASER HAVING AN INVERTED BEARING

TECHNICAL FIELD

The present invention relates to cam phasers for reciprocating internal combustion engines for altering the phase relationship between valve motion and piston motion; more particularly, to cam phasers having a vaned rotor disposed in an internally-lobed stator to form actuation chambers therebetween; and most particularly to an axially-compact cam phaser wherein an inverted sprocket or pulley hub bearing permits a large reduction in the axial length of the phaser compared with that of prior art phasers, while providing substantially equivalent torque capacity.

BACKGROUND OF THE INVENTION

Cam phasers are well known in the automotive art as elements of systems for reducing combustion formation of nitrogen oxides (NOX), reducing emission of unburned hydrocarbons, improving fuel economy, and improving engine torque at various speeds. As is known, under some operating conditions it is desirable to delay or advance the closing and opening of either the intake valves or the exhaust valves or both, relative to the valving in a similar engine having a fixed relationship between the crankshaft and the camshaft.

Cam phasers employ a first element driven in fixed relationship to the crankshaft and a second element adjacent to the first element and mounted to the end of the camshaft in either the engine head or block. The first element is typically a cylindrical stator mounted coaxially to a crankshaft-driven gear or pulley and having a plurality of radially-disposed chambers separated by inwardly-extending radial lobes and the second element is a vaned rotor mounted to the end of the camshaft through an axial bore in the stator and having a vane disposed in each of the stator chambers such that limited relative rotational motion is possible between the stator and the rotor. The chambers are sealed typically by front and rear face seals of the stator. The apparatus is provided with suitable porting so that hydraulic fluid, for example, engine oil under engine oil pump pressure, can be brought to bear controllably on opposite sides of the vanes in the chambers. Control circuitry and valving, commonly a multiport spool valve, permits the programmable control of the volume of oil on opposite sides of each vane to cause a change in rotational phase between the stator and the rotor, in either the rotationally forward or backwards direction, to either advance or retard the opening of the valves with respect to the position of the pistons in the cylinders.

Cam phaser designs heretofore have faced two powerful and antithetical needs: compact size and high torque capacity.

Regarding small size, many engine applications require the addition of a cam phaser unit within the envelope of an existing engine design which may have been in production for several years and which gives no special consideration to space for such a unit in the vicinity of the camshaft end. Thus, to be useful with as many engine designs as possible, a cam phaser should occupy as little volume as possible.

Regarding high torque capacity, a cam phaser must be capable of generating sufficient rotational torque between the stator and rotor to drive the advancing and retarding of valve opening and closing, which average torque for representative engines can be about 3 Nm. The rotational torque that a cam phaser is capable of generating depends on several variables including the operating temperature of the engine, the operating age of the engine, the viscosity of the oil, and numerous other known engine factors. Therefore, for smooth engine operation and rapid response under all anticipated oil pressure and use conditions, the torque capacity of a cam phaser should be substantially greater than the average torque of 3 Nm for representative engines.

Torque capacity is the product of force applied at a distance from an axis of rotation. The torque capacity ($T_1$) of a specific cam phaser can be expressed in terms of available oil pressure (P) and volume displacement per radian (V) as follows:

$$T_1=PV \quad \text{(Eq. 1)}$$

A volume parameter, referred to herein as the Phaser Envelope (PHE), is defined herein as pi times the square of the stator diameter D times the axial length L of the phaser, divided by 4, and represents the cylindrical volume required to contain the phaser:

$$PHE=(\pi D^2 L)/4 \quad \text{(Eq. 2)}$$

The radial dynamic load imposed by the engine on the timing sprocket or pulley of the cam phaser is quite large and requires a substantial axial length of bearing between the sprocket and the camshaft to sustain the load. In prior art cam phasers, such a bearing is provided adjacent to, and axially displaced from, the stator/rotor hydraulic components of the phaser, thereby extending substantially the overall axial length of the phaser, the space required in the engine envelope to accommodate the phaser and, most significantly, the cylindrical volume or phaser envelop (PHE) required to contain the phaser. The PHE, in $cm^3$, for prior art cam phasers having axially displaced bearings is typically in the range of 250 to 300. In a newer compact cam phaser design, disclosed in U.S. Patent to Lichti, et al titled "Diametrically Compact Cam Phaser", assigned to the assignee hereof, bearing Ser. No. 09/388,103, the cam phaser has a PHE of 190 $cm^3$ while still maintaining a torque capacity ($T_1$) of 4.8 Nm at 20 psi oil pressure. However, in the Diametrically Compact Cam Phaser, because the bearing is displaced axially away from the stator/rotor hydraulic components, approximately 36% of the unit's total PHE is used up in providing support for the radial load of the chain drive.

What is needed is a compact cam phaser having an axial length significantly less than that of prior art cam phasers such that the Phaser Envelope can be substantially smaller at no significant sacrifice in bearing load capability or torque capacity.

SUMMARY OF THE INVENTION

The present invention is directed to an axially-compact camshaft phaser wherein the bearing on the camshaft is axially inverted, in comparison to prior art cam phasers, so that the bearing extends inwardly of the phaser stator and rotor such that the bearing function is carried out over an axial length primarily within the hydraulic portion of the phaser rather than externally thereof. The overall axial length L and phaser envelop PHE of the phaser may be thereby significantly reduced without sacrificing torque capacity.

BRIEF DESCRIPTION OF THE DRAWINGS

The foregoing and other objects, features, and advantages of the invention, as well as presently preferred embodiments thereof, will become more apparent from a reading of the following description, in connection with the accompanying drawings in which.

DESCRIPTION OF THE PREFERRED EMBODIMENT

Figure 1:
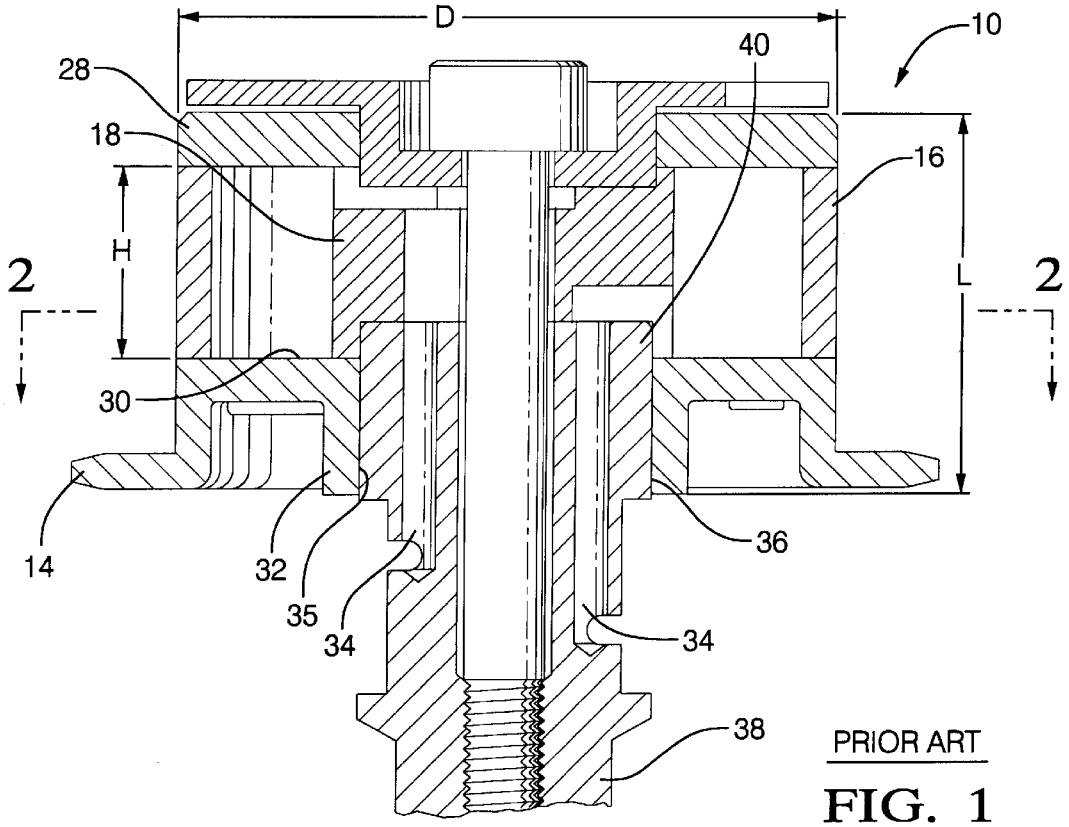
PRIOR ART FIG. 1
FIG. 1 is an axial cross-sectional view of the Diametrically Compact Cam Phaser taken along line 1—1 in FIG. 2, showing an axially displaced bearing of the prior art.
Figure 2:
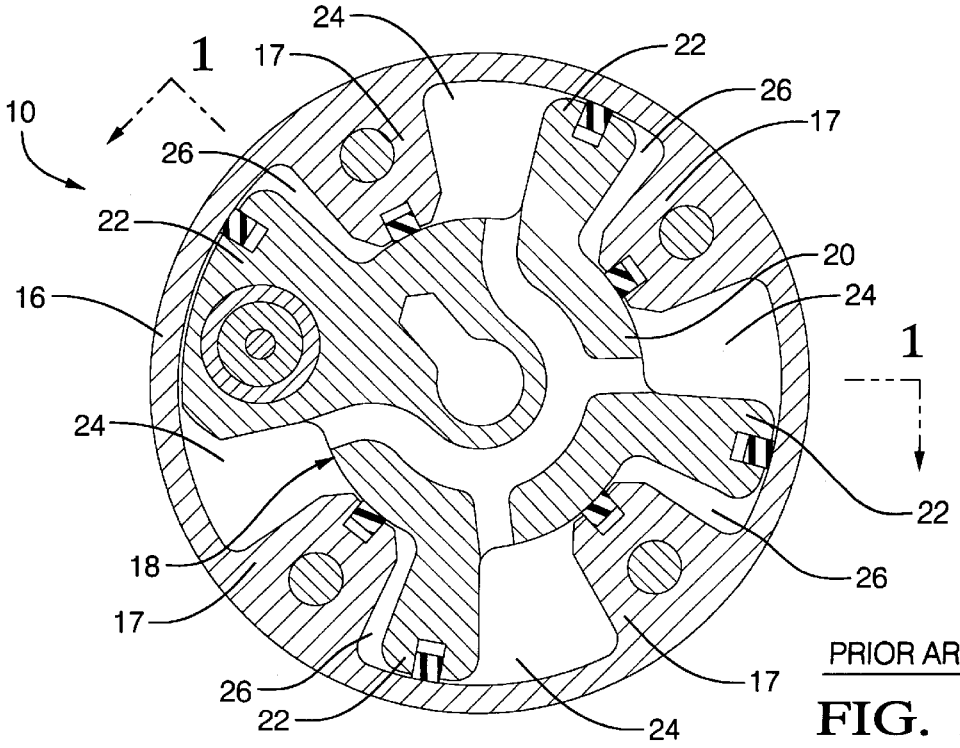
PRIOR ART FIG. 2
FIG. 2 is an axial-transverse cross-sectional view of the cam phaser shown in FIG. 1, taken along line 2—2 in FIG. 1.

The benefits of the present invention can be more fully appreciated by first examining Diametrically Compact Cam Phaser 10 having its bearing displaced away from its stator/rotor components, as in the prior art, as shown in FIGS. 1–2. Cam phaser 10 includes well-known generic components: a stator-drive element 14 (in this case, a chain drive sprocket); a stator 16 having a plurality of inwardly extending lobes 17; a rotor 18 having a cylindrical hub 20 and a plurality of outwardly-extending vanes 22; and a plurality of timing-advancing chambers 24 and timing-retarding chambers 26 being formed between the rotor vanes and the stator.

Chambers 24 and 26 are axially closed on a first side by a cover plate 28, which can be integral with stator 16, and on a second side by an axial face 30 of a bearing 32, which may be integral with stator-drive element 14. Oil for actuating the rotor with respect to the stator, by expanding the volume of chambers on first sides of the vanes and contracting the volume of chambers on second sides of the vanes, is distributed to the chambers via passages 34.

Bearing 32 has a cylindrical bore 35 which is rotatably disposed against journal 36 of camshaft 38, as shown in FIG. 1, to sustain the radial load imposed by the timing chain or belt in creating torque $T_1$. Journal 36 defines a portion of camshaft 38 which is axially separated from end portion 40 of camshaft 38, which may extend a distance into hub 20, as in FIG. 1. Thus, the load is borne on bearing elements 32 and 36 which are axially additional in length to the hydraulic elements 16, 18, and 28. Hence, the use of volumetric space in the vicinity of the end of the camshaft is rather inefficient. In some engines, the outermost camshaft bearing (not shown) is near enough to the end of the camshaft that phasers designed in accordance with the prior, art bearing design cannot be fitted thereto.

Figure 3:
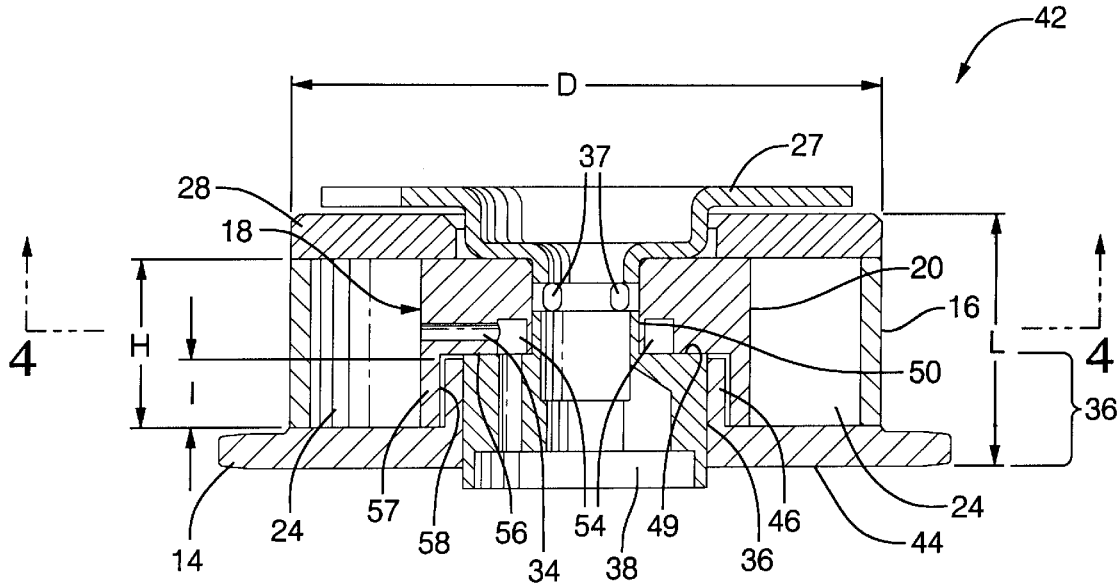
FIG. 3 is an axial cross-sectional view of an axially-compact cam phaser in accordance with the invention, taken along line 3—3 in FIG. 4, showing an inverted bearing extending into a well in the rotor.
Figure 4:
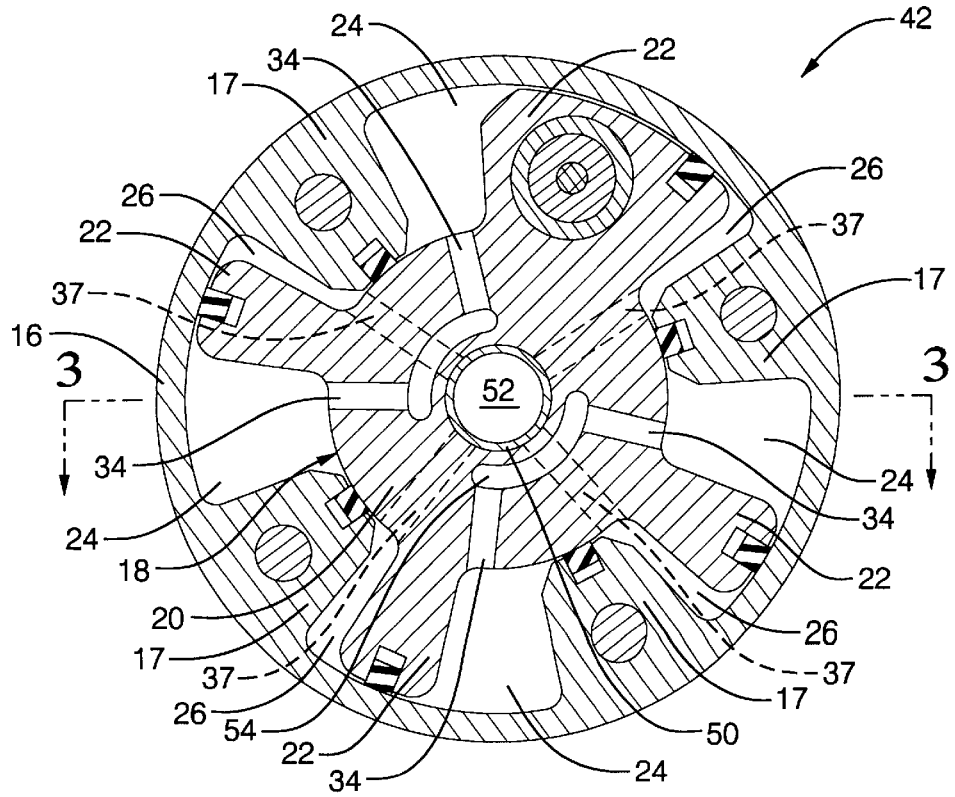
FIG. 4 is an axial-transverse cross-sectional view of the cam phaser shown in FIG. 3, taken along line 4—4 in FIG. 3.

Referring to FIGS. 3–4, an axially-compact camshaft phaser 42 in accordance with the invention includes the above-listed generic parts. Phaser 42 exhibits torque performance at least equivalent to prior art phasers within a much smaller Phaser Envelope (PHE).

Unlike the prior art stator drive elements, drive element 14 of phaser 42 is preferably of the minimum axial thickness required structurally to sustain the sprocket working load. Further, element 14 does not extend axially away from the hydraulic elements of the phaser, as in the prior art. Instead, preferably drive element 14 is substantially smooth on its outer axial face 44 and is provided with a cylindrical bearing flange 46 extending axially inwards of phaser 42 such that the journal portion 36 of camshaft extension 48 is included within stator drive element 14 and rotor 18. In the embodiment shown in FIGS. 3 and 4, camshaft 38 is a pre-existing camshaft which is provided with a press-fit extension 48, although, obviously, the end of camshaft 38 itself can be formed in the shape of extension 48 within the scope of the invention.

Phasers driven by dry timing belts typically require a cylindrical "snout" (not shown) extending rearwards of drive element 14 for cooperation with a rotating oil seal to prevent engine oil from reaching the timing belt. Therefore, phasers having oil-lubricated timing chains and gears can obtain the greatest measure of axial compactness from the invention, as the snout is obviated thereby.

Extension 48 preferably is provided with an axial face 49 and a cylindrical axial extension 50, onto which rotor 18 is pressed via central bore 52 therein such that rotor 18 is both centered on and rotationally fixed to extension 48 and hence to camshaft 38. Kidney shaped oil grooves 54 formed in axial face 56 of rotor 18 is sealed against face 49 to form passages which communicates with radial passages 34 in hub 20 and with feed passages 33 in camshaft 38 and extension 48 to supply oil to chambers 24. Similar radial passages 37 supply oil to chambers 26 from a supply via bore 52. Rotor face 56 extends radially beyond the inner end of bearing flange 46 and is recessed within rotor 18 by the length I of wall 57 substantially equal to the axial length of flange 46, face 56 and wall 57 forming thereby a well 58, as shown in FIG. 3.

Recessing the bearing up into the rotor/stator while maintaining the same torque capacity requires either an increase in stator axial height (H) or an increase in overall diameter (D) over the prior art. The embodiment shown in FIGS. 3–4 maintains the stator axial height (H) while increasing overall diameter (D). This slight diameter increase moderately increases the volume occupied by the rotor/stator hydraulic components but dramatically reduces the volume required for the bearing support. The total improvement by this invention is a 25% reduction of the overall length (L) of the cam phaser and a reduction of the PHE by 15%.

A cam phaser in accordance with the invention, having radial bearing surfaces recessed within a well in the rotor, has a phaser envelope PHE less than 190 $cm^3$, a stator diameter D less than 80 mm, a stator axial height H less than 23 mm, an overall axial length L less than 40 mm, a hydraulic capacity of at least 16 ml, and a phase operating range of at least 250°, provides a torque $T_1$ of at least 5.0 Nm at 20 psi oil pressure. A preferred embodiment thereof, providing 5.0 Nm of torque $T_1$ at 20 psi has a phaser envelope PHE of 162 $cm^3$, a stator diameter D of 79 mm, a stator axial height H of 22 mm, an overall axial length L of 33 mm, a hydraulic capacity of 16 ml, and a phase operating range of 30°.

The foregoing description of the invention, including a preferred embodiment thereof, has been presented for the purpose of illustration and description. It is not intended to be exhaustive nor is it intended to limit the invention to the precise form disclosed. It will be apparent to those skilled in the art that the disclosed embodiments may be modified in light of the above teachings. The embodiments described are chosen to provide an illustration of principles of the invention and its practical application to enable thereby one of ordinary skill in the art to utilize the invention in various embodiments and with various modifications as are suited to the particular use contemplated. Therefore, the foregoing description is to be considered exemplary, rather than limiting, and the true scope of the invention is that described in the following claims.

What is claimed is:

1. An axially-compact camshaft phaser for use on a camshaft, comprising:

a) a stator having a plurality of inwardly-extending spaced-apart radial lobes;

b) a stator-drive element connected to said stator on a first surface of said element;

c) a rotor having first and second spaced-apart axial faces, said rotor being disposed in said stator and having a plurality of vanes extending outwardly from a hub to form a plurality of chambers between said stator and said rotor, said rotor having a cylindrical axial well formed in one of said axial faces; and d) a bearing flange having a bearing surface disposed on said camshaft, said bearing flange being connected to said stator drive element and extending into said well in said rotor to carry radial operating loads imposed on said phaser.

2. A phaser in accordance with claim 1 wherein said bearing surface extends through said stator drive element.

3. A phaser in accordance with claim 1 wherein said stator has an axial height less than 23 mm.

4. A phaser in accordance with claim 1 further comprising a cover plate having an inner surface disposed against said stator.

5. A phaser in accordance with claim 4 wherein said cover plate is integral with said stator.

6. A phaser in accordance with claim 4 wherein said cover plate has an outer surface opposite said inner surface, and wherein said stator-drive element has a second surface opposite said first surface, and wherein the overall axial length of said phaser between said cover plate outer surface and said stator-drive element second surface is less than 40 mm.

7. A phaser in accordance with claim 6 wherein the Phaser Envelope, defined as pi times the square of the stator outer diameter times the overall axial length of the phaser divided by 4, is less than 250 $cm^3$.

8. A phaser in accordance with claim 6 having a hydraulic capacity of at least 16 ml and a phase operating range of at least 25°.

9. A phaser in accordance with claim 8 having a torque capacity of at least 4.8 Nm.

10. A phaser in accordance with claim 9 wherein said stator outer diameter is 79 mm, said overall axial length is 33 mm, said hydraulic capacity is 16 ml, and said phase operating range is 30°.

* * * * *